US007703393B2

(12) United States Patent
Faist

(10) Patent No.: US 7,703,393 B2
(45) Date of Patent: Apr. 27, 2010

(54) DEVICES FOR ADJUSTING CONTACT PRESSURE EXERTED ON AN ADJACENT ROTATING BODY BY A ROLLER IN A ROLLER STRIP AND/OR FOR ARRANGING THE ROLLER ON THE ROTATIONAL BODY AND/OR FOR DISCONNECTING THE CYLINDER FROM THE ROTATING BODY

(75) Inventor: Bernd Klaus Faist, Ochsenfurt (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 437 days.

(21) Appl. No.: 10/587,293

(22) PCT Filed: Jan. 28, 2005

(86) PCT No.: PCT/EP2005/050359

§ 371 (c)(1),
(2), (4) Date: Jul. 25, 2006

(87) PCT Pub. No.: WO2005/072965

PCT Pub. Date: Aug. 11, 2005

(65) Prior Publication Data

US 2008/0163771 A1 Jul. 10, 2008

(30) Foreign Application Priority Data

Jan. 30, 2004 (DE) ..... 10 2004 004 665

(51) Int. Cl.
*B41F 5/00* (2006.01)

(52) U.S. Cl. ..... 101/216; 101/483

(58) Field of Classification Search ..... 101/6, 101/212, 216, 217, 480, 483
See application file for complete search history.

(56) References Cited

U.S. PATENT DOCUMENTS

| | | | |
|---|---|---|---|
| 3,131,631 | A | 5/1964 | Haskin |
| 3,157,118 | A | 11/1964 | Mosemiller |
| 5,142,977 | A | 9/1992 | Gertsch et al. |
| 5,323,703 | A | 6/1994 | Blaser |
| 5,448,949 | A | 9/1995 | Bucher |

(Continued)

FOREIGN PATENT DOCUMENTS

| | | |
|---|---|---|
| DE | 38 25 517 | 2/1990 |

(Continued)

*Primary Examiner*—Daniel J Colilla
*Assistant Examiner*—David Banh
(74) *Attorney, Agent, or Firm*—Jones, Tullar & Cooper, P.C.

(57) ABSTRACT

Actuators are used to adjust a contact pressure exerted by a roller on an adjacent rotating body in a roller strip, or for arranging the roller on the rotating body or for separating the roller from the adjacent rotating body. The roller has ends that are mounted in a roller lock which includes several of these actuators. The actuators are supplied with a fluid under pressure, with a pressure level that can be controlled. The actuators, and preferably also the roller lock, have an identification characteristic such that for a selected roller lock, the contact pressure of a control unit, which can be actuated remotely, and which is exerted by the roller on the adjacent rotating body, can be adjusted by the actuators in response to the pressure level supplied to these actuators.

63 Claims, 6 Drawing Sheets

U.S. PATENT DOCUMENTS

| | | | |
|---|---|---|---|
| 5,588,364 | A | 12/1996 | Bolza-Schunemann |
| 5,819,656 | A | 10/1998 | Gertsch et al. |
| 6,098,542 | A | 8/2000 | Dufour |
| 6,761,112 | B2 | 7/2004 | Faist et al. |
| 2003/0089254 | A1 | 5/2003 | Reder et al. |
| 2004/0050274 | A1 | 3/2004 | Faist et al. |
| 2005/0076800 | A1 | 4/2005 | Faist et al. |
| 2005/0223924 | A1 | 10/2005 | Faist et al. |
| 2006/0042485 | A1 | 3/2006 | Schneider et al. |
| 2006/0124005 | A1 | 6/2006 | Miescher et al. |

FOREIGN PATENT DOCUMENTS

| | | | |
|---|---|---|---|
| DE | 197 30 681 | | 4/1998 |
| DE | 100 01 582 | | 8/2000 |
| DE | 101 13 313 | | 9/2002 |
| DE | 102 44 043 | | 6/2003 |
| DE | 102 44 046 | | 4/2004 |
| DE | 102 61 983 | | 4/2004 |
| WO | WO 02/074541 | | 9/2002 |
| WO | WO 03/049946 | | 6/2003 |
| WO | WO 03/049947 | A2 * | 6/2003 |
| WO | WO 2004/028810 | | 4/2004 |
| WO | WO 2005/021264 | | 3/2005 |

* cited by examiner

DEVICES FOR ADJUSTING CONTACT PRESSURE EXERTED ON AN ADJACENT ROTATING BODY BY A ROLLER IN A ROLLER STRIP AND/OR FOR ARRANGING THE ROLLER ON THE ROTATIONAL BODY AND/OR FOR DISCONNECTING THE CYLINDER FROM THE ROTATING BODY

CROSS-REFERENCE TO RELATED APPLICATIONS

This patent application is the U.S. national phase, under 35 USC 371, of PCT/EP2005/050359, filed Jan. 28, 2005; published as WO 2005/072965 A1 on Aug. 11, 2005 and claiming priority to DE 10 2004 004 665.4, filed Jan. 30, 2004, the disclosures of which are expressly incorporated herein by reference.

FIELD OF THE INVENTION

The present invention is directed to devices that are used to adjust contact pressure exerted on an adjacent rotational body by a roller in a roller strip and/or to engage the roller on the rotational body and/or to disengage said roller from the rotational body. Ends of the roller, or rollers which are adjustable, either in contact pressure or position, are seated in a support bearing having a roller mount that is capable of radial travel. Each of the support bearings has at least one actuator. The actuators are each controlled by separate control units.

BACKGROUND OF THE INVENTION

Devices that are used to adjust rollers in a printing machine are known from DE 102 44 043 A1. Each end of a roller, that exerts contact pressure on an adjacent rotational body, is seated in a support bearing having a roller mount that is capable of radial travel. Each support bearing is being equipped with multiple actuators that act on the roller and which can be pressurized with a pressure medium. A roller that can be displaced in this manner is also engaged, for example, against a forme cylinder.

From DE 38 25 517 A1, a device for engaging and for disengaging rollers, and for adjusting inking unit and dampening unit rollers in a printing machine is known. A stored-program controller automatically regulates the positioning of an inking or a dampening roller relative to a fixed distribution roller by the use of an input, preset adjustment pressure. The stored-program controller issues a positioning command to an electrically activated actuator, and the actuator, which is configured as a direct current motor, transmits the positioning command to the positioning element, wherein that positioning element is responsible for mechanically adjusting the inking roller or the dampening roller. The electrically activated actuator, and the positioning element are arranged in a roller lock of the adjustable inking or dampening unit roller. With the device known from DE 38 25 517 A1, a remote adjustment of the inking or the dampening rollers is possible. Beginning with an initial position for the adjustable inking or dampening rollers, for different production types, adjustment values for other positions can be stored in the stored-program controller. Thus, the adjustment values for the inking or the dampening rollers are based upon the selected production type, with pre-set adjustment values for the different positions being determined based upon specific production types by the stored-program controller, by the use of a program.

WO 03/049946 A2 and the subsequently published WO 2004/028810 A1 disclose methods for operating an inking unit or dampening unit of a printing machine. In the inking unit or in the dampening unit, at least three rollers or cylinders are provided, which can be placed against one another, thereby forming at least two adjacent roller strips. At least one of the rollers is seated in a machine frame such that it can be displaced relative to the other rollers. The displaceably seated roller is pressed into the gap between the adjacent rollers, with a degree of force that is adjustable in terms of its magnitude and its direction, in order to allow the variable adjustment of the respective contact pressure in the two roller strips.

SUMMARY OF THE INVENTION

The object of the present invention is directed to providing devices for adjusting contact pressure exerted on an adjacent rotational body by a roller in a roller strip and/or for engaging the roller on the rotational body and/or for disengaging that roller from the rotational body. A width of the roller strip, which is formed between the roller and its adjacent rotational body, can be adjusted as needed, even when the printing couple is running in production.

The object is attained according to the invention by the provision of support for the ends of the rollers whose position or contact pressure is to be changed in support bearings having a roller mount which is capable of radial travel. Each one of the support bearings has at least one actuator that acts on the roller. At least one actuator in a support bearing is controlled by a control unit separately and independently of an actuator in another support bearing. The control unit determines the contact pressure exerted by one of the rollers, in at least one of the roller strips, on its adjacent rotational body from radial forces exerted by actuators in the same support bearing. A control element of the control unit allows the contact pressure to be changed.

The benefits that can be achieved with the present invention consist especially in that the contact pressure that is exerted on an adjacent rotational body, by a roller in a roller strip, can be individually adjusted as needed by a control unit, especially by addressing individual actuators that play a part in the adjustment, and further in that an existing setting can be changed, preferably remotely, such as, for example, even when the printing couple is running in production. Because the contact pressure is adjustable, the width of the roller strip which is formed between the roller and its adjacent rotational body, can be adjusted as needed, which width adjustment capability produces a beneficial effect on the quality of the printed product that is produced with the printing machine. The adjustment of the contact pressure is preferably accomplished by the use of a support bearing, which is also called a roller lock, that is equipped with at least one actuator. In each roller lock that plays a part in the adjustment of a roller, multiple identifiable actuators are preferably arranged, which individual actuators are individually selectable and therefore can be individually actuated directly or indirectly by the control unit Each of the activated actuators exerts a radial force that is directed toward the interior of its roller lock. A vector sum of the radial forces, preferably exerted by multiple actuators, form the contact pressure exerted by the roller on the adjacent rotational body. The radial forces, which are exerted by the actuators, can preferably be adjusted separately and independently of one another, and are also set by the control unit for a desired operating position. The actuators, like the respective roller strips and the roller locks which are allocated to them, can each be clearly identified by the use of an identification code. Actuators, which are connected to a common pressure source, can be activated in groups, but are preferably activated individually. Based on the arrangement of controllable devices and their respective connections, such as, for example, via conduits for transporting pressure medium, the actuators of a specific roller lock, which are connected to different pressure sources, can, for example, be activated together, while actuators of another roller lock that are connected to the same pressure sources remain inactive. In the case of a forme cylinder, which is not completely covered with printing formes in an axial direction, the contact pressure that is exerted by a roller engaged against this forme cylinder can be set differently at the two axial ends of this roller. When the control unit receives the instruction, for example by the use of a corresponding input via a control element that is a part of the control unit, to change the setting of the contact pressure in a selected roller strip, the control unit calculates the amount of pressure that should be applied to which actuator in the affected roller lock, and implements whatever adjustment may be necessary in the pressure setting, such as, for example, by actuating one or more controllable devices in order to adjust the pressure in selected actuators. To implement the contact pressure whose value is to be adjusted, the control unit controls valves, which are preferably arranged in the pressure conduits, and which may preferably be rapid-reaction, electrically or electromagnetically actuatable proportional valves. An adjustment of a contact pressure value can thus be implemented within a few seconds.

BRIEF DESCRIPTION OF THE DRAWINGS

Preferred embodiments of the present invention are represented in the drawings and will be described in greater detail below.

The drawings show.

DESCRIPTION OF THE PREFERRED EMBODIMENTS

Figure 1:
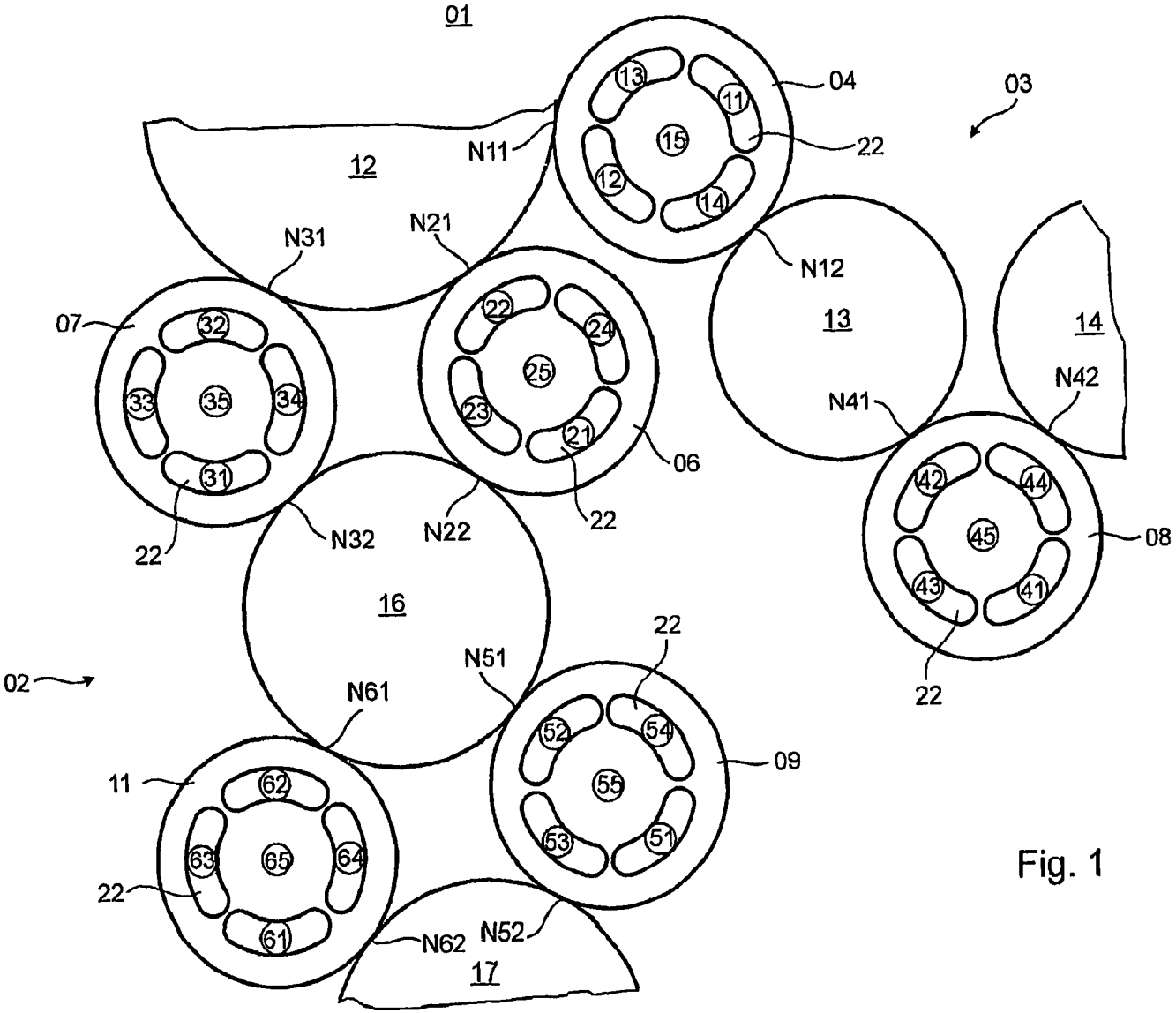
FIG. 1, a schematic side elevation view of a printing couple comprising an inking unit and a dampening unit, each with rollers that are adjustable in terms of their contact pressure.

Referring initially to FIG. 1, there may be shown, in a schematic, simplified, side elevation representation, a first printing couple 01 comprising an inking unit 02 and a dampening unit 03, each with rollers 04; 06; 07; 08; 09; 11 that are adjustable with respect to their contact pressure. The rollers 04; 06; 07; 08; 09; 11, which are adjustable, in terms of their contact pressure, are seated such that they can be displaced. In this depicted preferred embodiment illustrated example, each of these adjustable rollers 04; 06; 07; 08; 09; 11 is in direct contact with two adjacent rotational bodies 12; 13; 14; 16; 17. In other words, each of these rollers 04; 06; 07; 08; 09; 11 is simultaneously engaged with two of the rotational bodies 12; 13; 14; 16; 17 which are provided in this arrangement. The result is that each of these rollers 04; 06; 07; 08; 09; 11 has, on its circumferential surface, two roller strips N11; N12; N21; N22; N31; N32; N41; N42; N51; N52; N61; N62, which may also be called nip-points N11; N12; N21; N22; N31; N32; N41; N42; N51; N52; N61; N62, and which extend essentially axially relative to the respective roller 04; 06; 07; 08; 09; 11. Each roller that is adjustable in terms of its contact pressure 04; 06; 07; 08; 09; 11, presses, through its respective roller strip N11; N12; N21; N22; N31; N32; N41; N42; N51; N52; N61; N62, and with an adjustable level of contact pressure, against its adjacent rotational bodies 12; 13; 14; 16; 17. The roller 04 is configured, for example, as a dampening forme roller 04, and forms its first nip-point N11 with a rotational body 12, which is configured, for example, as a cylinder 12, and especially as a forme cylinder 12. Roller 04 forms its second nip-point N12 with a rotational body 13, which is structured, for example, as a dampening distribution roller 13. The roller 06 is, for example, an ink forme roller 06, and forms its first nip-point N21 with the forme cylinder 12, and forms a second nip-point N22 with a rotational body 16, such as, for example, an ink transfer roller 16. The roller 07 is also structured as, for example, an ink forme roller 07 and forms its first nip-point N31 with the forme cylinder 12 and its second nip-point N32 with the ink transfer roller 16. In the dampening unit 03, a further roller 08 that is adjustable, with respect to its contact pressure, is provided, such as, for example, as an intermediate roller 08, which forms its first nip-point N41 with the dampening distribution roller 13 and its second nip-point N42 with another dampening unit roller 14. In the inking unit 02, two additional rollers 09 and 11 that are adjustable in terms of their contact pressure are provided, and are for example, two intermediate rollers 09 and 11. The intermediate inking roller 09 forms its first nip-point N51 with the ink transfer roller 16 and its second nip-point N52 with another inking unit roller 17. The intermediate inking roller 11 forms its first nip-point N61 with the ink transfer roller 16 and its second nip-point N62 with the other inking unit roller 17.

Figure 2:
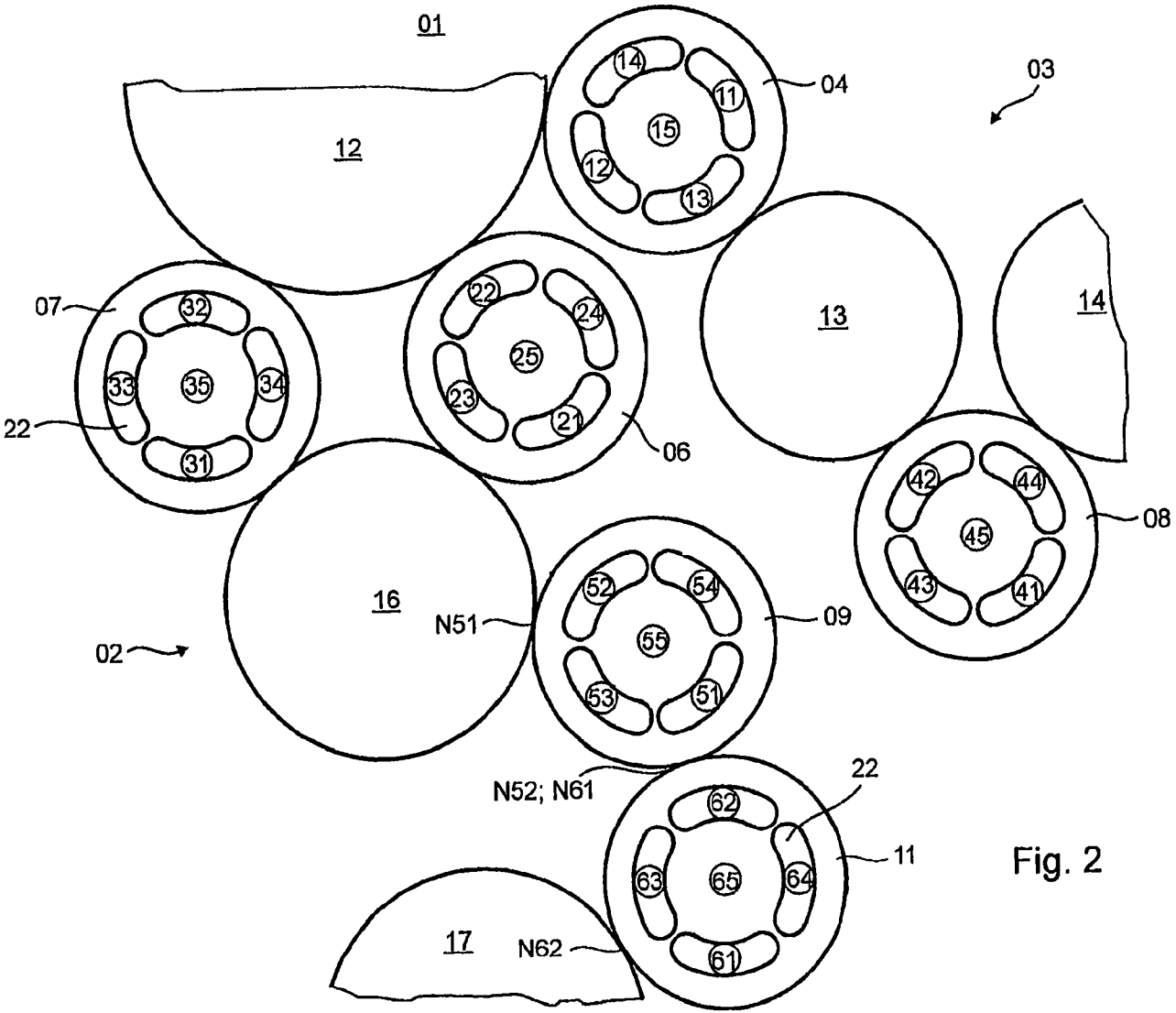
in FIG. 2, a schematic side elevation view of a printing couple comprising an inking unit and a dampening unit, each with rollers that are adjustable in terms of their contact pressure, wherein in the inking unit, two rollers that are adjustable in terms of their contact pressure are engaged against one another.

A similar, second printing couple 01 is illustrated, also schematically, also in side elevation in FIG. 2 and includes an inking unit 02 and a dampening unit 03, each with rollers 04; 06; 07; 08; 09; 11 that are adjustable in terms of their contact pressure. This second printing couple differs from the first printing couple 01 shown in FIG. 1 in the positioning of the intermediate inking roller 11 in the inking unit 02. In the second printing couple 01 shown in FIG. 2, the intermediate inking roller 11 is not in direct contact with the ink transfer roller 16 at its first nip-point N61. Rather, the intermediate inking roller 11 is engaged against the other intermediate inking roller 09, so that roller 09 forms its second nip-point N52 not with the additional inking unit roller 17, but with the intermediate inking roller 11. Thus, in this example, the nip-points N52; N61 both designate the same roller strips N52; N61. In the arrangements shown in FIGS. 1 and 2, the adjustable rollers 04; 06; 07; 08; 09; 11 each have two nip-points N11; N12; N21; N22; N31; N32; N41; N42; N51; N52; N61; N62. However, in the printing couple 01, an operational position for at least one of these adjustable rollers 04; 06; 07; 08; 09; 11 can also be provided, in which the at least one adjustable roller 04; 06; 07; 08; 09; 11 is in direct contact with only one adjacent rotational body 12; 13; 14; 16; 17, and is disengaged from its second adjacent rotational body 12; 13; 14; 16; 17. A further operational position for at least one of the adjustable rollers 04; 06; 07; 08; 09; 11 can provide that the at least one adjustable roller 04; 06; 07; 08; 09; 11 is disengaged from all of its adjacent rotational bodies 12; 13; 14; 16; 17, while each of the remaining adjustable rollers 04; 06; 07; 08; 09; 11 in this printing couple 01 is in direct contact with at least one adjacent rotational body 12; 13; 14; 16; 17. It is also possible for only one adjacent rotational body 12; 13; 14; 16; 17 to be provided for at least one of the adjustable rollers 04; 06; 07; 08; 09; 11 in the printing couple 01.

The printing couple 01 is arranged in a printing machine that produces a printed product. The printing machine is configured, for example, as a newspaper printing press and is equipped, for example, with multiple ones of the printing couples 01, each of which is provided with at least one inking unit 02 and/or with one dampening unit 03. The printing couple 01 can operate, for example, in a planographic printing process, and preferably can operate in an offset printing process. A transfer cylinder that is part of the printing couple 01, and an impression cylinder that operates in conjunction with the transfer cylinder, are not specifically represented in FIGS. 1 and 2. The dampening unit 03 is omitted when the printing couple 01 is to be used in a dry offset printing process.

The circumferential surface of the rotational body 12, which is configured, for example, as a forme cylinder 12, is covered with at least one printing forme which is not specifically shown. Preferably, multiple printing formes, and especially four or six printing formes, are arranged in an axial direction on the forme cylinder 12. In the circumferential direction of each forme cylinder 12, for example, two printing formes are arranged in tandem, so that a total of up to eight or twelve printing formes can be arranged on the circumferential surface of the same forme cylinder 12. The printing couple 01 can have a total of significantly more, but can also have fewer adjustable rollers 04; 06; 07; 08; 09; 11 in its inking unit 02 and in its dampening unit 03 than the number of such adjustable rollers which are shown, by way of example, in FIGS. 1 and 2.

In each area of direct contact between rollers 04; 06; 07; 08; 09; 11 and rotational bodies 12; 13; 14; 16; 17 which are engaged on one another, a flattened area is formed on the cylindrical, circumferential surface of the roller 04; 06; 07; 08; 09; 11, on the cylindrical, circumferential surface of the rotational body 12; 13; 14; 16; 17, or of both. A chord of the flattened area corresponds to the width of the roller strip N11; N12; N21; N22; N31; N32; N41; N42; N51; N52; N61; N62 that extends on the circumference of the roller 04; 06; 07; 08; 09; 11 or of the rotational body 12; 13; 14; 16; 17. The flattening of the otherwise cylindrical circumferential surface of the roller 04; 06; 07; 08; 09; 11 or of the rotational body 12; 13; 14; 16; 17 is possible because the roller 04; 06; 07; 08; 09; 11, or its adjacent rotational body 12; 13; 14; 16; 17, or both, have an elastically deformable circumferential surface. For example, the adjustable rollers 04; 06; 07; 08; 09; 11 preferably each have a rubberized circumferential surface.

To achieve a high quality of the printed product to be produced using the printing couple 01, it is necessary to set the roller strips N11; N12; N21; N22; N31; N32; N41; N42; N51; N52; N61; N62 which are present in the printing couple 01, each to a specific width, with that specific width lying within the range of a few millimeters and amounting, for example, to between 1 mm and 10 mm. The rollers 04; 06; 07; 08; 09; 11 that can be adjusted, in terms of their contact pressure, and their adjacent rotational bodies 12; 13; 14; 16; 17 each have a diameter of, for example, 100 mm to 340 mm and an axial length of, for example, between 1,000 mm and 2,400 mm. The width of the roller strip N11; N12; N21; N22; N31; N32; N41; N42; N51; N52; N61; N62 corresponds to the contact pressure, which is exerted by the respective adjustable roller 04; 06; 07; 08; 09; 11, on its adjacent rotational body 12; 13; 14; 16; 17 in the respective roller strip N11; N12; N21; N22; N31; N32; N41; N42; N51; N52; N61; N62.

Each roller 04; 06; 07; 08; 09; 11, that can be adjusted in terms of its contact pressure, is seated at least at one of its ends 18, and preferably at both of its ends 18, in a support bearing 21. The support bearing 21 has a roller mount 39 that is capable of radial travel, or in other words is a so-called roller lock 21. Each support bearing 21 or roller lock 21 has at least one and preferably has multiple actuators 22 that act upon the supported roller 04; 06; 07; 08; 09; 11. The actuators 22, in turn, are preferably arranged in a housing which is a component of the support bearing 21 or roller lock 21. Each actuator 22 can be pressurized, for example, with a pressure medium. In the discussion which follows, although the actuators 22 are described as actuators 22 that can be pressurized with a pressure medium, which description corresponds to their preferred embodiment, the to be- described control of the support bearings 21 and/or of their actuators 22 is independent of the medium that is used to exert the contact pressure. To implement the appropriate control, in accordance with the present invention, the actuators 22 can also be configured, for example, as actuators 22 that exert the respective contact pressure, on the basis of, for example, hydraulic, electric, motor-driven or piezoelectric action. In any case, activated actuators 22 cause the roller mount 39 to move eccentrically relative to the support bearing 21, within a plane that extends orthogonally to the axial direction of the adjustable roller 04; 06; 07; 08; 09; 11. The radial travel of the roller mount 39, relative to the support bearing 21 can occur in a linear or non-linear path of motion.

Figure 3:
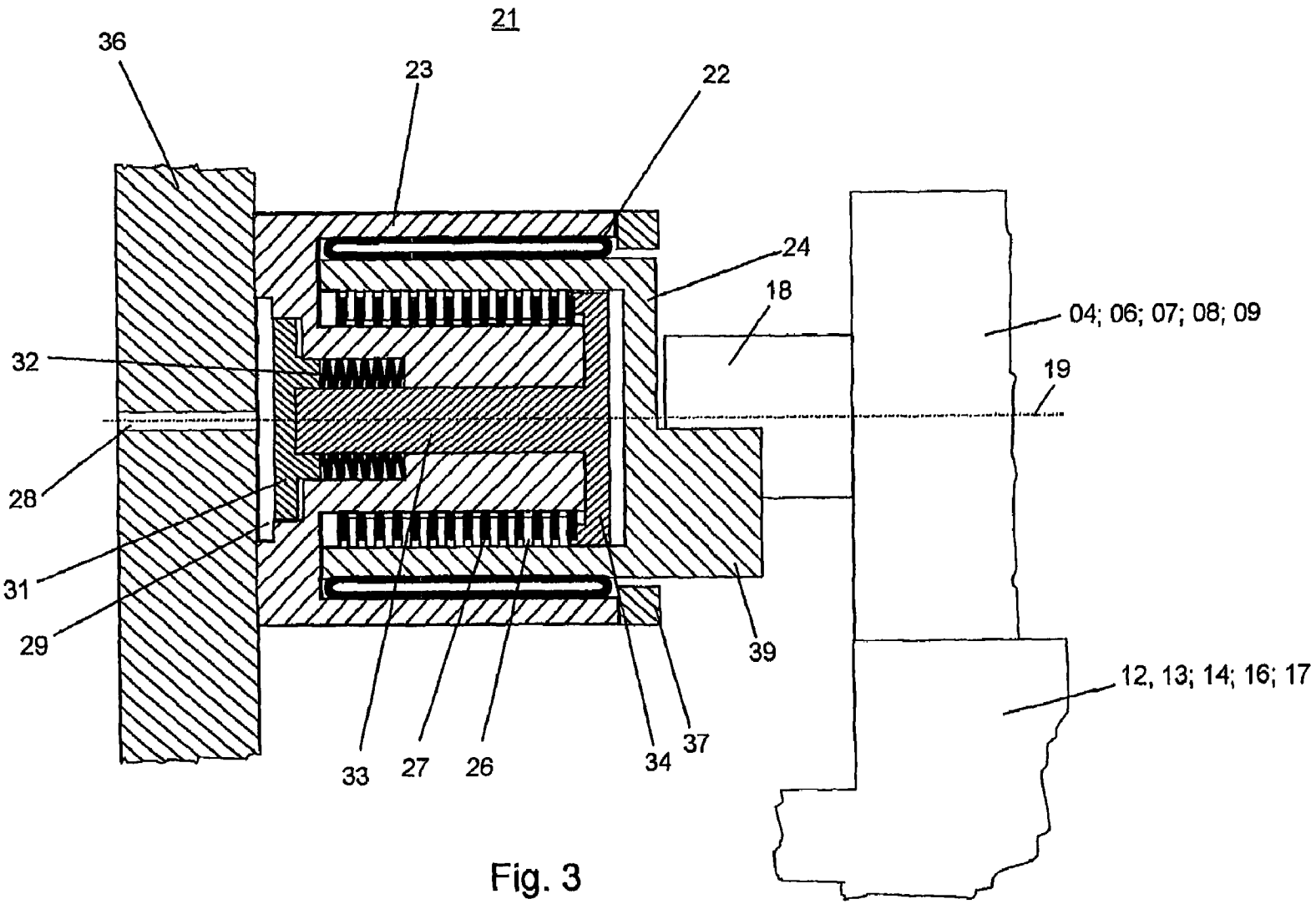
in FIG. 3, a cross-sectional view of a roller lock in accordance with the present invention.
Figure 4:
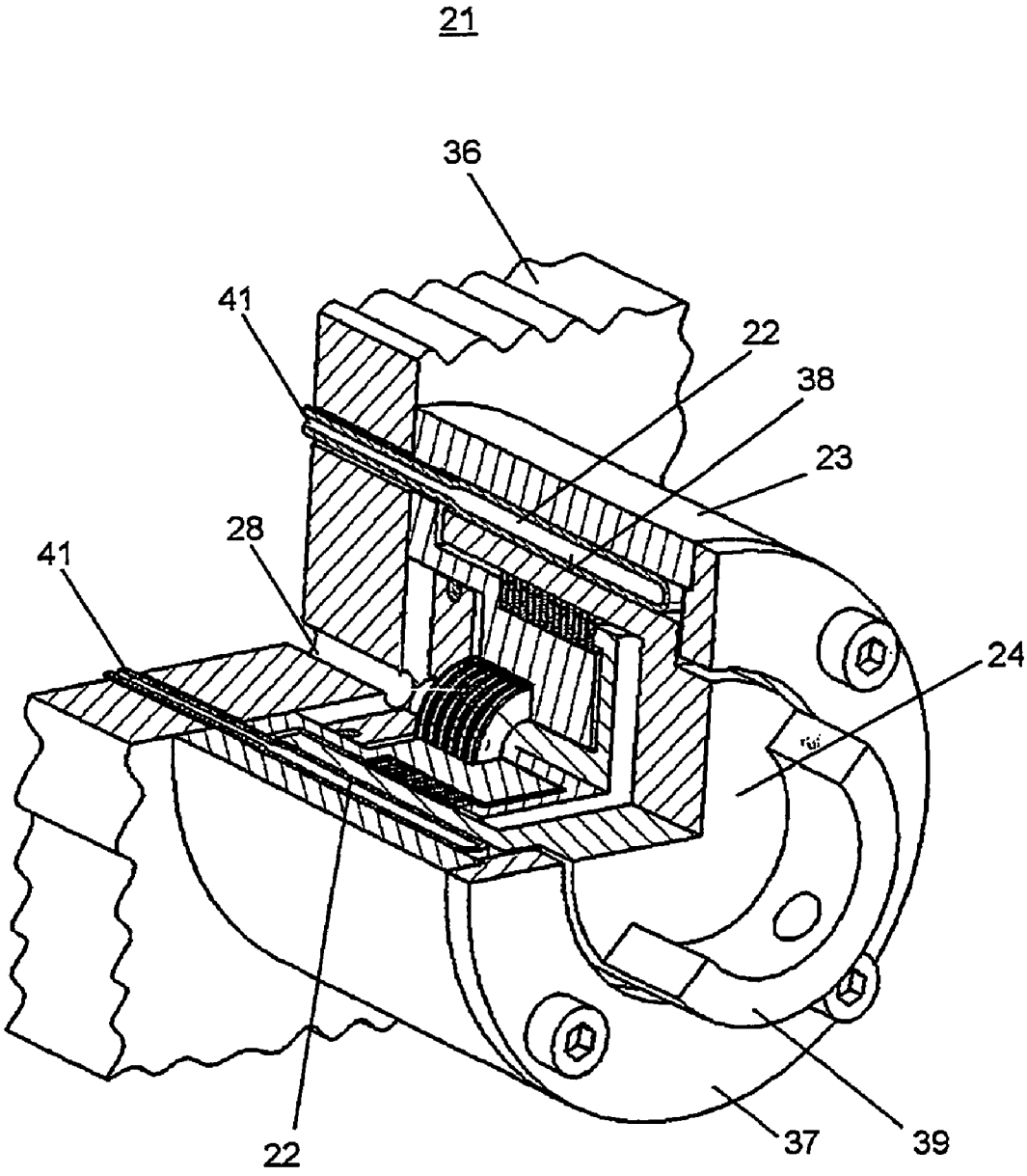
in FIG. 4 a perspective view of the roller lock of FIG. 3, partly in cross-section, taken in two orthogonal perpendicular planes.

A permissible radial travel of the roller mount 39 in the roller support bearing 21, which roller support bearing 21 is, for example, stationary, thus causes an eccentric displacement of the roller mount 39 in the support bearing 21, which is preferably configured as a radial bearing. In FIG. 3, and in FIG. 4 a roller lock 21 is represented by way of example. FIG. 3 shows the roller lock 21 in a longitudinal section that runs parallel to the axis 19 of the roller 04; 06; 07; 08; 09; 11. FIG. 4 shows the roller lock 21 of FIG. 3 from a perspective view with a partial longitudinal section that is taken in two orthogonal, perpendicular planes. At least each roller 04; 06; 07, which operates directly in conjunction with a forme cylinder 12, has at least one actuator 22, which one actuator is controlled independently of the other actuators 22 of each of the rollers 04; 06; 07 that also operate directly in conjunction with the forme cylinder 12. Preferably, it is provided that at least three rollers 04; 06; 07, that all operate directly in conjunction with the forme cylinder 12, are provided, and that each of these rollers 04; 06; 07 has at least one independently controlled actuator 22.

The housing of the roller lock 21 includes a sleeve-shaped frame holder 23, inside of which a roller holder 24 is seated. The actuators 22, when they are activated, act upon the roller holder 24 and can displace the roller holder 24 radially, in a gap that is formed radially around the axis 19, between the frame holder 23 and the roller holder 24. The width of the gap between the frame holder 23 and the roller holder 24 measures, for example, from 1 mm to 10 mm, and preferably is approximately 2 mm. The actuators 22 are arranged, for example, in the gap between the frame holder 23 and the roller holder 24, or in a chamber or recess in the frame holder 23. Each actuator 22 that is arranged in the chamber or recess in the frame holder 23 has an active surface 38 that faces the roller holder 24, with which the actuator 22 exerts surface pressure on the roller holder 24 when that actuator is in its operational state, in which operational state it is pressurized by a pressure medium.

The actuators 22 are preferably arranged in the housing, or sleeve-shaped frame holder, of the roller lock 21 so as to be non-rotatable relative to this housing, or at least relative to the frame holder 23. Each of the actuators 22 is structured, for example, as a tubular component, such as a pressure hose, that can be pressurized with a pressure medium. The tubular component has at least one surface 38, as seen in FIG. 4 made of a reversibly deformable elastomeric material, with that surface 38 being configured in a further embodiment that is not significantly shown here, as a membrane. When the tubular component is pressurized with the pressure medium, that membrane 38 preferably comes to rest against an outer circumferential surface of the roller holder 24. The reversibly deformable surface 38 thus conforms, at least largely, to the surface 38 of the actuator 22 that effectively exerts the surface pressure. In the preferred embodiment, the actuators 22 have no pistons, which are guided in a cylinder, and no piston rod. The integration of the actuators 22 into the housing of the roller lock 21 clearly results in an extremely compact construction of the roller lock 21. The pressure medium is supplied to each of the actuators 22 via a pressure conduit 41, as is depicted in FIG. 4.

One of the ends 18 of the roller 04; 06; 07; 08; 09; 11 that is adjustable, in terms of its contact pressure, is seated in the roller mount 39, which is, for example, semicircular, as may be seen in FIG. 4, and which is preferably configured as a quick-release coupling, and which is rigidly connected to the roller holder 24. Each of the rollers 04; 06; 07; 08; 09; 11, that are adjustable in terms of its contact pressure, is capable of rotating on its own axis 19. As an alternative to the rigid connection of the roller mount 39 to the end of the roller 04; 06; 07; 08; 09; 11, the roller mount 39 can have a bearing, such as a roller bearing or a plain bearing, in which the end of the roller 04; 06; 07; 08; 09; 11 is rotatably seated. The sleeve-shaped frame holder 23 is attached, for example, to a side frame 36 of the printing couple 01. The roller lock 21 is sealed against dust, moisture and other contaminants by a sealing element 37 that preferably covers especially the gap between the frame holder 23 and the roller holder 24, and that is situated at the end surface of the roller lock that faces the roller 04; 06; 07; 08; 09; 11 which is adjustable in terms of its contact pressure. The sealing element 37 is attached to the frame holder 23, for example, via screws which are depicted in FIG. 4. With the inclusion of the sealing element 37, especially the actuators 22 are also protected against contamination and thus are protected against any impairment of their mobility. The radial displacement of the roller holder 24 in the frame holder 23 also allows a roller 04; 06; 07; 08; 09; 11 to be engaged on its adjacent rotational body 12; 13; 14; 16; 17, or to be disengaged from it.

The roller lock 21 is equipped, for example, with a fixation device, which immobilizes the roller holder 24, and thus also immobilizes the roller 04; 06; 07; 08; 09; 11 that is rigidly connected to it, in a first operational position, thereby locking it in place against any radial displacement relative to the frame holder 23. In a second operational position, the fixation device releases the roller holder for such radial displacement relative to the frame holder 23. The fixation device comprises, for example, a preferably coaxial first multi-plate assembly 26 that is rigidly connected to, for example, the roller holder 24, and also comprises a preferably coaxial second multi-plate assembly 27. Plates of the second multi-plate assembly 27 engage or interdigitate between the plates of the first multi-plate assembly 26. The immobilization is accomplished by the plates meshing with one another, preferably frictionally or positively. Once the frictional or positive contact of the plates has been released, the second multi-plate assembly 27 is capable of moving in the axial direction of the roller lock 21.

Axial movement of the second multi-plate assembly 27 is accomplished, for example, in that a pressure medium is supplied through a channel 28 that is formed in the side frame 36, into a pressure chamber 29 which is located in the roller lock 21. A pressure plate 31, which is arranged in the pressure chamber 29, moves a plunger 33, which is preferably arranged in the roller holder 24, axially, against the force of a spring element 32. The second multi-plate assembly 27 is fastened to a plunger head 34 of the plunger 33, and is thus also moved with the axial movement of the plunger 33, thereby causing the plates in the multi-plate assemblies 26; 27 to become disengaged from each other. When the pressure exerted on the pressure plate 31 by the pressure medium in the pressure chamber 29 is switched off, the force exerted by the spring element 32 guides the plates of the multi-plate assemblies 26; 27 back into engagement with one another, thereby immobilizing the roller holder 24, which, as discussed above, can be radially displaced relative to the frame holder 23 by the actuators 22 in the roller lock 21, in the frame holder 23.

Figure 5:
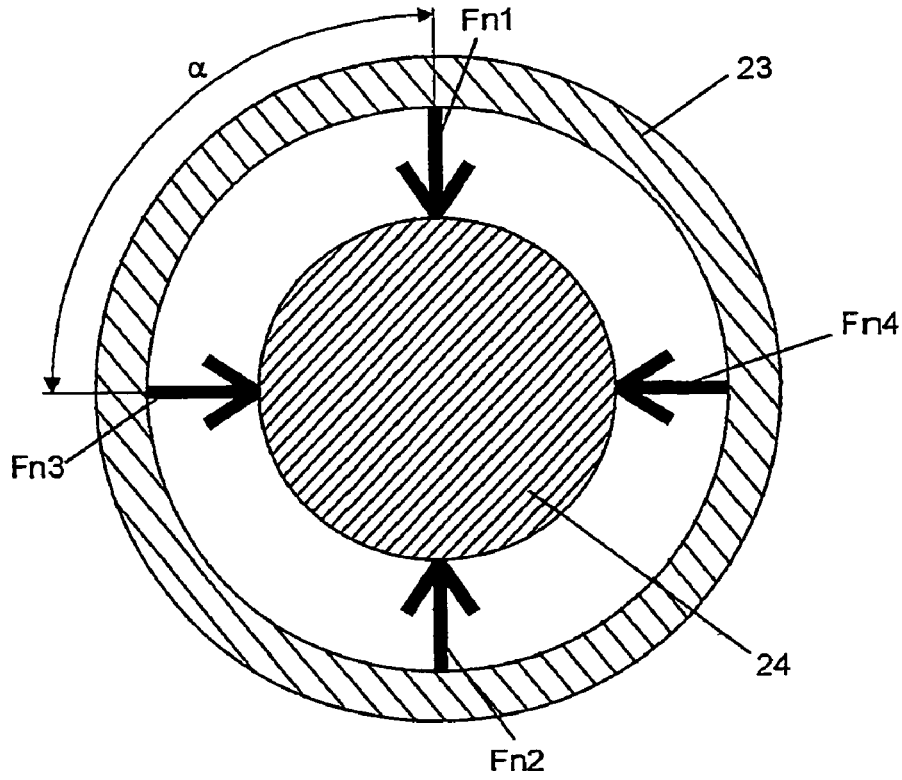
in FIG. 5, a schematic representation of radial forces exerted by actuators on an adjustable roller without a displacement of the adjustable roller.
Figure 6:
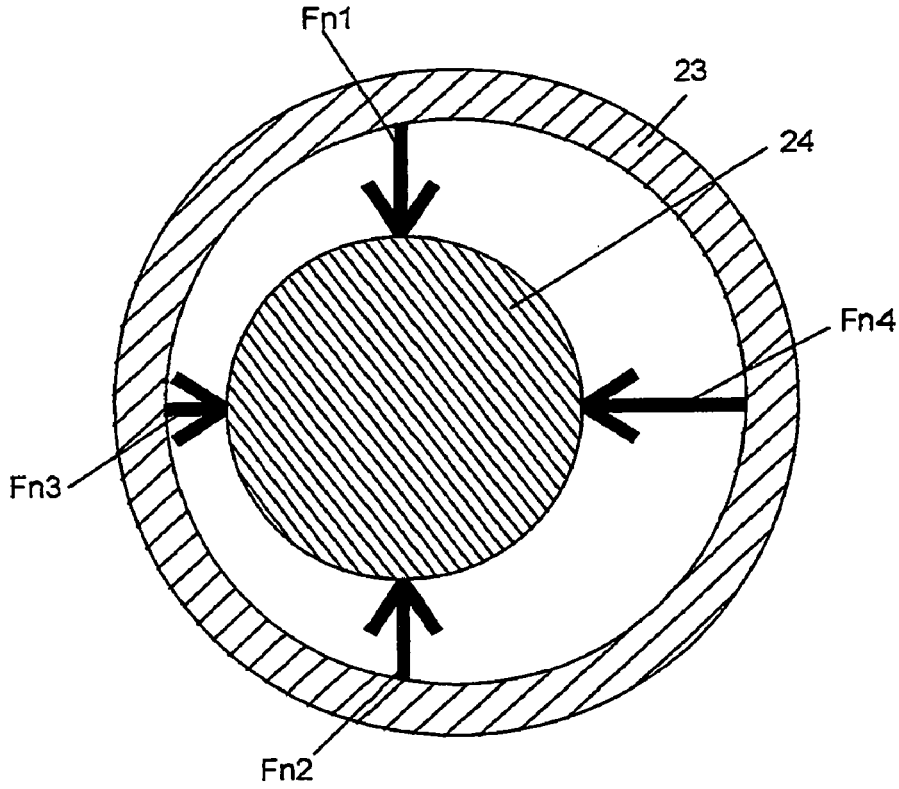
in FIG. 6, a schematic representation of radial forces exerted by actuators on an adjustable roller with a displacement of the adjustable roller; and in FIG. 7, a schematic depiction of a pneumatic layout for activating actuators and fixation devices that are components of a printing couple.

In the preferred embodiment shown in FIG. 1 through 4, each roller lock 21 is equipped with four actuators 22, which are arranged in a circular pattern around the axis 19 of the roller 04; 06; 07; 08; 09; 11. These four actuators 22 are preferably distributed, with equal spacing, around the axis 19 of the roller 04; 06; 07; 08; 09; 11 that is adjustable in terms of its contact pressure. The actuators 22 are remotely controllable. In other words, actuators 22 can be activated by the use of a control unit 60 which is depicted schematically in FIG. 7, and are preferably configured as pneumatic actuators 22. A compressed gas, preferably compressed air, is used as the pressure medium, for example. Possible alternatives to the preferred pneumatic actuators 22 are especially hydraulic actuators 22, which are impinged upon by a fluid, or electromotive actuators 22. As is shown in FIG. 5 and 6 in a schematic representation, each actuator 22, when it has been pressurized with a pressure medium, exerts a radial force Fn1; Fn2; Fn3; Fn4, directed toward the interior of its roller lock 21, on the roller 04; 06; 07; 08; 09; 11 that is connected to the roller lock 21 and which radial force is adjustable in terms of its contact pressure. The actuators 22 are preferably radially supported against or in the frame holder 23 of the roller lock 21, and exert the radial force Ff1; Fn2; Fn3; Fn4 on the roller 04; 06; 07; 08; 09; 11, which is attached to the roller holder 24 and which radial force is adjustable in terms of its contact pressure. This is accomplished by exerting the surface pressure on the roller holder 24 that is arranged in the frame holder 23 such that the roller holder 24 can be radially displaced. Accordingly, the pressure exerted by the pressure medium in the respective actuator 22 and the radial force Fn1; Fn2; Fn3; Fn4 of that actuator 22 correspond to one another. Radial forces Fn1; Fn2; Fn3; Fn4 exerted simultaneously by the plurality of actuators 22 situated in the same roller lock 21 form an opening angle with one another, which opening angle, deviates from 0° and 180°, preferably lying between 45° and 135°, and is, for example, 90°. The contact pressure that is exerted on an adjacent rotational body 12; 13; 14; 16; 17 by a roller 04; 06; 07; 08; 09; 11, which is adjustable in terms of its contact pressure, in a roller strip N11; N12; N21; N22; N31; N32; N41; N42; N51; N52; N61; N62 then is a result of a vector sum of the radial forces Fn1; Fn2; Fn3; Fn4 that are exerted simultaneously by the actuators 22 in one roller lock 21, and, if applicable, taking into account a force of weight that is at least partially exerted on the adjacent rotational body 12; 13; 14; 16; 17 by the adjustable roller 04; 06; 07; 08; 09; 11, as a function of its own mass.

With an identifying element "n" in the radial force designator Fn1; Fn2; Fn3; Fn4 a specific roller lock 21 can be designated and therefore identified. Further discussion of the significance of the identifying element "n" will be addressed below. Preferably, each roller lock 21 that is built into the printing machine, and which is a component of an adjustable roller 04; 06; 07; 08; 09; 11, is assigned an identification code that can be used in the control process as an address with which the roller lock 21 can be clearly identified in the printing machine or at least in a printing couple 01, and which roller lock 21 can thereby be selected in the control process. In the same manner, each actuator 22 that is a part of a roller lock 21, is also assigned an identification code. This identification code insures that each actuator 22 in one of the roller locks 21 that are arranged in the printing machine or in the respective printing couple 01 can be clearly identified, selected, and controlled. Furthermore, as with the above-described identification codes, the pressure chamber 29 that is part of the fixation device of each roller lock 21 is assigned an identification code. Each fixation device for the roller locks 21 that are arranged in the printing machine or in the printing couple 01 can be clearly identified. The respective identification code for each of the roller locks 21, their actuators 22 and their fixation device is preferably machine readable and can be stored in the control unit 60, which control unit 60 is preferably an electronic control unit that processes digital data.

In the preferred embodiment which is shown in FIG. 1 through 4, the identification code for the actuators 22 and the fixation device of each roller lock 21 consists of a series of numerals, with a first numeral designating the relevant roller lock 21 and with a second numeral designating the relevant actuator 22 in the respective roller lock 21 or its fixation device. Thus, each identification code nm, with an identifying element n; m for the roller lock 21, its actuators 22 and its fixation device, designates a clearly specified roller lock 21 in the printing couple 01, a clearly specified actuator 22 in the printing couple 01, and a clearly specified fixation device in the printing couple 01. The identification code nm thus specifies a roller lock 21 with its first identifying element n, and a specific actuator 22 in this roller lock 21, or its fixation device, with its second identifying element m. For example, the identification code "12" consisting, for example, of a two-digit number, designates with its first numeral the roller lock 21 identified by the number "1" which in the example shown in FIG. 1 through 4 is assigned to the dampening forme roller 04. The second numeral in the numeric sequence, which in this case was selected as the number "2"., designates a very specific actuator 22 in the roller lock 21 identified by the number "1". The identification code "15" in this example designates the fixation device of the roller lock 21 that is designated by the number "1 In the example shown in FIG. 1 through 4, the identification code nm relates to numeric sequences comprised of a first identifying element "n" comprising a number between "1". and "6"., because six roller locks 21 requiring differentiation are provided, and a second identifying element "in" comprising a number between "1" and "5" for the four actuators 22 for each roller lock 21 and the allocated fixation device. Because each roller lock 21 each of its actuators 22, and each fixation device in the printing couple 01 is assigned an identification code nm, each roller lock 21, each actuator 22 and each fixation device can be clearly identified and addressed. The identification codes nm can each be stored, for example, in the control unit 60 as an individual, unambiguous address, with which each roller lock 21, each actuator 22 and each fixation device can be identified, selected, addressed and controlled by the control unit, separately and independently of other roller locks 21, actuators 22 and fixation devices arranged in the printing couple 01.

When both ends 18 of the same roller 04; 06; 07; 08; 09; 11, that can be adjusted in terms of contact pressure and/or its position, can be changed, and/or when at least one end 18 of two different rollers 04; 06; 07; 08; 09; 11, that can each be adjusted in terms of contact pressure and/or their positions, can be changed, and when both such ends are each seated in a support bearing 21, in other words in a roller lock 21 having a roller mount 39 that is capable of radial travel, with each support bearing 21 having at least one actuator 22 that acts upon the roller 04; 06; 07; 08; 09; 11, the control unit 60 controls at least the actuator 22 of at least the two support bearings 21 supporting the roller ends 18 separately and independently of other support bearings 21 and actuators 22. The control unit 60 accordingly controls at least one actuator 22 in a support bearing 21 separately and independently of an actuator 22 in another support bearing 21. The control unit 60 can also control groups of actuators 22 and support bearings 21 together, particularly if these jointly controlled actuators 22 and support bearings 21 form a functional system, or if, in other words, and based upon their technical function in the printing process, these actuators 22 and support bearings 21 must continuously and necessarily be positioned in a fixed arrangement relative to one another.

The at least two actuators 22 in each roller lock 21 are always arranged the same in their preferably circular distribution in each roller lock 21, with respect to a specific position of the roller lock 21, so that in all of the roller locks 21 in a printing couple 01, the identifying element "m" for its actuators 22 and its fixation device can always be assigned in the same order. Accordingly, the same identifying element "m" is always assigned to actuators 22 occupying the same position in this sequence. For example, the actuators 22 and the fixation device are identified in ascending order, with the identification code for the fixation device being assigned the highest value in this order. The actuators 22 in each roller lock 21 are thereby designated in a fixed order. For example, starting from a specific position on the circumference of the roller lock 21, the actuators 22 in each roller lock 21 are designated in the same fixed order in the circumferential direction.

In each roller lock 21, the actuators 22, in their preferred pneumatic embodiment, are each connected via a pressure conduit 41 to a pressure source, such as a compressor, with a pressure level 42. As is apparent from the pneumatic layout shown in FIG. 7, it can be provided that actuators 22 arranged in different roller locks 21, which, due to their identical arrangement in their respective roller lock 21, are assigned the same identifying element m, are connected in parallel via the same pressure conduit 41 to the same pressure source or are maintained at least at the same pressure level 42. Actuators 22 that are arranged in the same roller lock 21, but which are assigned a different identifying element "m", are connected via different pressure conduits 41 to different pressure sources or at least are maintained at different pressure levels 42.

It can be provided that the actuators 22, which are arranged in the roller locks 21, are constantly pressurized, and that the incoming pressure acts to displace the adjustable roller 04; 06; 07; 08; 09; 11 and/or acts as a contact pressure exerted on the adjustable roller 04; 06; 07; 08; 09; 11 that is to be changed, only if, and for as long as the fixation device of the relevant roller lock 21 is released. In other words, it is in the operating position that will permit the displacement of the adjustable roller 04; 06; 07; 08; 09; 11. If, and for as long as the fixation device of the relevant roller lock 21 is restricting the displacement of the adjustable roller 04; 06; 07; 08; 09; 11, pressure which is acting on at least one of the actuators 22, or a change in the incoming pressure, will have no effect on the adjustable roller 04; 06; 07; 08; 09; 11. If, and for as long as no effect on the adjustable roller 04; 06; 07; 08; 09; 11 is intended, the pressure conduits 41 to the actuators 22 that operate in conjunction with this roller 04; 06; 07; 08; 09; 11, instead of being continuously pressurized, can also be set to be at least partially pressureless or at least substantially pressure-reduced.

Roller locks 21 that are connected to, and that support the same roller 04; 06; 07; 08; 09; 11 that is adjustable, in terms of its contact pressure, preferably each have the same number of actuators 22. As in the example described here, the roller locks 21 of multiple or even all the rollers 04; 06; 07; 08; 09; 11 that can be adjusted, in terms of their contact pressure, can have the same number of actuators 22. In a printing couple, a side frame 36, in, or on which, a first support point for the rollers 04; 06; 07; 08; 09; 11, which are adjustable in terms of contact pressure, along with their adjacent rotational bodies 12; 13; 14; 16; 17, is located, is customarily designated as "Side I". An opposite side frame 36, with a second support point for the rollers 04; 06; 07; 08; 09; 11 that are adjustable in terms of their contact pressure, along with their adjacent rotational bodies 12; 13; 14; 16; 17, is customarily designated as "Side II".

In the prior art, actuators 22 in roller locks 21 that are connected to the same roller 04; 06; 07; 08; 09; 11 exert an equal level of contact pressure on the adjacent rotational body 12; 13; 14; 16; 17 at both ends 18 of that roller 04; 06; 07; 08; 09; 11 in the roller strip N11; N12; N21; N22; N31; N32; N41; N42; N51; N52; N61; N62. If, however, the rotational body 12, which is configured as a forme cylinder 12, is not evenly covered with printing formes in its axial direction, and instead that forme cylinder 12 is, for example, only half covered or at least is not continuously covered with printing formes, it is advantageous, in accordance with the present invention, to be able to set the contact pressure that is exerted on the forme cylinder 12 at the two ends 18 of the same roller 04; 06; 07; 08; 09; 11 at different levels. In this case, the vector sum of the radial forces Fn1; Fn2; Fn3; Fn4 of the actuators 22 in the roller lock 21 on "Side I" will differ from the vector sum of the radial forces Fn1; Fn2; Fn3; Fn4 of the actuators 22 in the roller lock 21 on "Side II".

Figure 7:
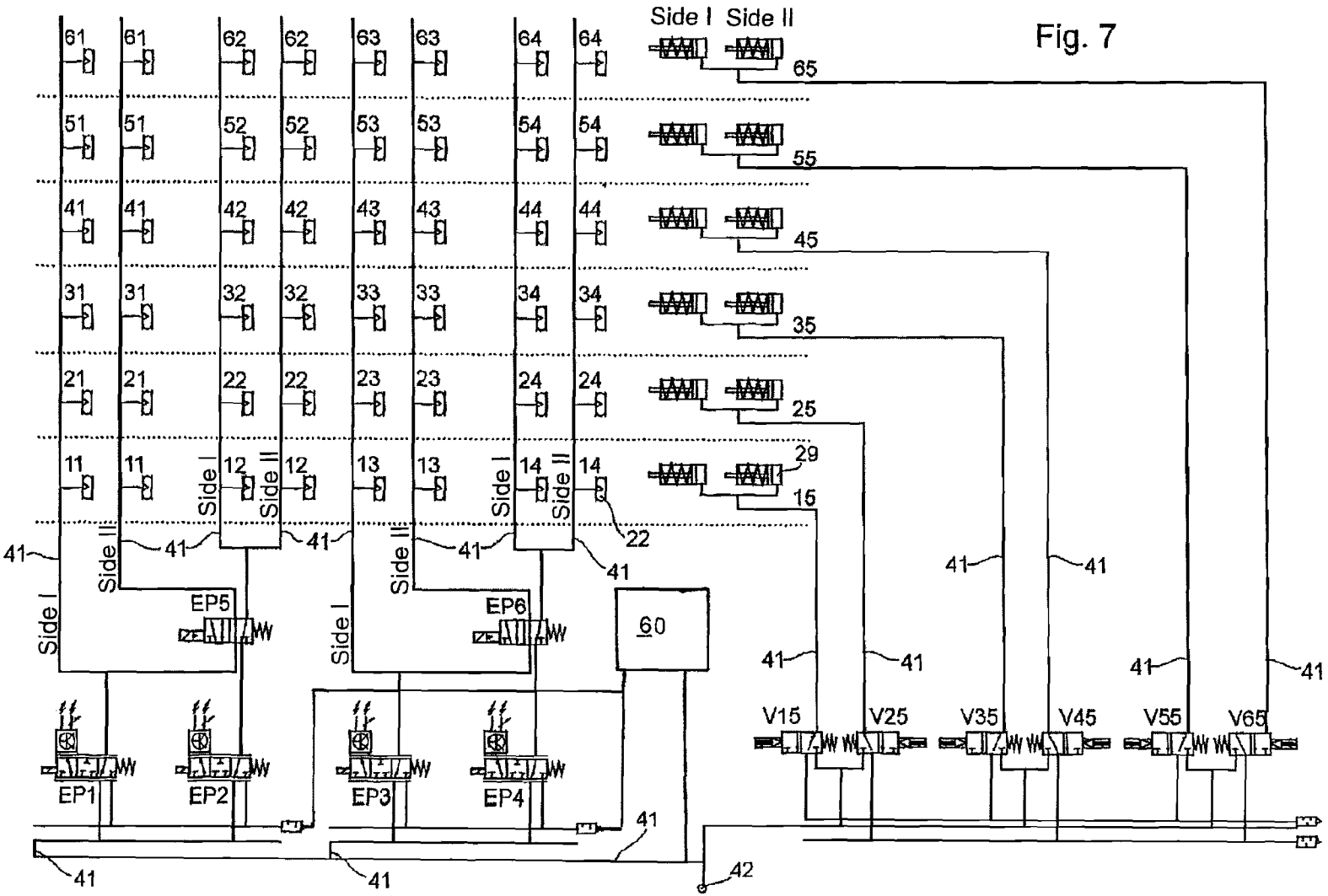

In the preferred embodiment of a pneumatic circuit for the actuators 22, as shown in FIG. 7, in all of the roller locks 21 which are arranged in the printing couple 01, are preferably either electrically or electromagnetically activated, controllable devices which are arranged in the pressure conduit 41 that leads from the pressure source, which devices are preferably configured as rapid-reaction proportional valves EP1; EP2; or EP3; EP4, such as, for example, 3/3-way proportional valves EP1; EP2; EP3; EP4. These valves determine the pressure level 42 that is present at the respective actuators, and wherein, for example, one of the proportional valves EP1; EP2; EP3; EP4 is allocated to each roller lock 21. The control unit 60 activates actuators 22 which are arranged in the roller locks 21, via the proportional valves EP1; EP2; EP3; EP4. Two additional controllable devices are provided in the circuit, which preferably are configured as electrically or as electromagnetically actuatable valves EP5; EP6, such as, for example, as 5/2-way valves, and which are arranged in the pressure conduit 41 on the pathway of the pressure medium from its pressure source to the actuators 22 in a series connection, downstream from one of the proportional valves EP1; EP2; EP3; EP4. These 5/2-way valves allow the selection of whether actuators 22 on "side I" of the roller 04; 06; 07; 08; 09; 11, that is adjustable in terms of its contact pressure, will be pressurized at the same pressure as "Side II"., or at a different pressure. The pressure level 42 can be adjusted by the use of the proportional valves EP1; EP2; EP3; EP4 to any level, such as for example, between 0bar and 10bar, and preferably between 0bar and 6bar.

The fixation devices 28; 29; 31, 32; 33; 24 for the roller locks 21 of the same roller 04; 06; 07; 08; 09; 11 are, for example, connected in parallel in their respective pressure conduit 41, and thus preferably change their operating position at the same time. With preferably also electrically or electromagnetically actuated valves V15; V25; V35; V45; V55; V65, such as, for example, 3/2-way valves V15; V25; V35; V45; V55; V65, each fixation device is placed either in a first operational position, in which the fixation device blocks the essentially radial displacement of the roller 04; 06; 07; 08; 09; 11 that is adjustable in terms of its contact pressure, or is placed in a second operational position, in which the fixation device permits the essentially radial displacement of the roller 04; 06; 07; 08; 09; 11 that is adjustable in terms of its contact pressure.

As an alternative to, or in addition to the circuit for the actuators 22 shown in FIG. 7, a controllable device can be allocated to each roller lock 21. Such a controllable device can apply pressure to multiple, and to preferably all, pressure conduits 41 for actuators 22 in the same roller lock 21 at the same time, with these pressure conduits 41 being connected to their respective pressure sources, at a first pressure level 42 in a first operational position and at a second pressure level 42 in a second operational position. In both of the operational positions, the pressure level 42 that exists at the actuators 22 in each case is different from zero for at least one of the actuators 22 in the same roller lock 21. All of the actuators 22 in one roller lock 21 are thereby pressurized at the same time, at their respective pressure levels 42, which preferably differ from one another in the two operational positions of the controllable device.

In the two operational positions of the controllable device, the pressure level 42 that exists at multiple ones of, or at all actuators 22 in one roller lock 21 is also completely different, so that each of the actuators 22 in one roller lock 21 is pressurized at a different pressure level 42. Actuators 22, which are designated by the same identifying element "m" in different roller locks 21, can have the same pressure level 42, while actuators 22 in the same roller lock 21 having different identifying elements "m" as a rule have different pressure levels 42. The switch between the first operational position and the second operational position is preferably made abruptly via a switching operation of the controllable device, as initiated by the control unit. Accordingly, the controllable device acts on pressure conduits 41 that lead to all actuators 22 in the same roller lock 21 in the same manner, and can comprise, for example, a flow-check valve having multiple passageways that are independent of one another, or multiple synchronously, or in other words, simultaneously, switched flow-check valves, or a switching position for the proportional valves EP1; EP2; EP3; EP4. Because the adjustment of all of the actuators that are involved in the switch is performed simultaneously, or in other words, is performed synchronously, the adjustment of contact pressure that is exerted on an adjacent rotational body 12; 13; 14; 16; 17 by a roller 04; 06; 07; 08; 09; 11 in a roller strip N1l; N12; N21; N22; N31; N32; N41; N42; N51; N52; N61; N62 occurs rapidly, or, in other words, occurs within a very short period of time. In this manner, during an adjustment of the setting of the inking unit 02 or the dampening unit 03, especially when the printing couple is running in production, an unstable operating condition, that tends to lead to vibrations, is prevented. If multiple rollers 04; 06; 07; 08; 09; 11 each seated in roller locks 21 are provided, with each roller lock 21 having an identifying element "n"., the control unit 60 selects the controllable device that is allocated to each roller lock 21 in each case based upon the identifying element "n".

The printing couple 01 can have a standard configuration with respect to the contact pressure exerted by rollers 04; 06; 07; 08; 09; 11, with that standard configuration comprising a set of values FN11; FN12; FN21; FN22; FN31; FN32; FN41; FN42; FN51; FN52; FN61; FN62, wherein each such value FN11; FN12; FN21; FN22; FN31; FN32; FN41; FN42; FN51; FN52; FN61; FN62 corresponds to a contact pressure exerted by roller 04; 06; 07; 08; 09; 11 of this printing couple 01 in a roller strip N11; N12; N21; N22; N31; N32; N41; N42; N51; N52; N61; N62 on a rotational body 12; 13; 14; 16; 17 that is adjacent to the respective roller 04; 06; 07; 08; 09; 11. The standard configuration can, for example, consist of numerical values, of value pairs or of value sequences which are listed in a table or graphic. The control unit 60 accesses these numerical values, value pairs or value sequences using a program intended for adjusting a desired contact pressure, which program is run in the control unit 60, and which uses these numerical values, value pairs or value sequences to adjust the desired contact pressure.

In the preferred embodiment shown in FIGS. 1, 2 and 7, six rollers 04; 06; 07; 08; 09; 11 that are adjustable in terms of their contact pressure, with a total of twelve roller strips N11; N12; N21; N22; N31; N32; N41; N42; N51; N52; N61; N62, are provided in the printing couple 01. Each roller 04; 06; 07; 08; 09; 11, that is adjustable in terms of its contact pressure, is seated in a roller lock 21 having four actuators 22. Taking into account the option of being able to set contact pressures of different values on "Side I" and "Side II" of the printing couple 01, the standard configuration for this printing couple 01 can comprise a set of twenty-four values FN11; FN12; FN21; FN22; FN31; FN32; FN41; FN42; FN51; FN52; FN61; FN62. For each of these roller strips N11; N12; N21; N22; N31; N32; N41; N42; N51; N52; N61; N62, the value FN11; FN12; FN21; FN22; FN31; FN32; FN41; FN42; FN51; FN52; FN61; FN62 of the contact pressure being exerted therein is, in each case, formed from a vector sum of the radial forces Fn1; Fn2; Fn3; Fn4 which are exerted simultaneously by actuators 22 in the same roller lock 21, and if applicable, taking into account the force of weight which is exerted, at least partially, by the roller 04; 06; 07; 08; 09; 11 that is adjustable, in terms of its contact pressure, on its adjacent rotational body 12; 13; 14; 16; 17 based upon its own mass. Thus, to each value FN11; FN12; FN21; FN22; FN31; FN32; FN41; FN42; FN51; FN52; FN61; FN62 of one of the contact pressures, five additional values, which are comprised of the four radial forces Fn1; Fn2; Fn3; Fn4 and, if applicable, the mass of the adjustable roller 04; 06; 07; 08; 09; 11 are allocated. Furthermore, each value for a radial force Fn1; Fn2; Fn3; Fn4 can be subdivided to indicate its absolute value and its direction of action.

The values FN11; FN12; FN21; FN22; FN31; FN32; FN41; FN42; FN51; FN52; FN61; FN62 of the contact pressures exerted in the roller strips N11; N12; N21; N22; N31; N32; N41; N42; N51; N52; N61; N62, the values of the radial forces Fn1; Fn2; Fn3; Fn4 allocated to each of these, which are preferably subdivided into value and direction of action, and, if applicable, the mass of the adjustable roller 04; 06; 07; 08; 09; 11 are preferably stored in a memory device in the control unit 60. Also stored in the memory device of the control unit 60 are preferably the value of the gravitational constants for calculating the force of weight from the mass of the adjustable roller 04; 06; 07; 08; 09; 11, and for each roller 04; 06; 07; 08; 09; 11 that is controllable, in terms of its contact pressure, a value for the distance from the center point of the roller 04; 06; 07; 08; 09; 11, which lies on its axis 19, to the center point of the respective adjacent rotational body 12; 13; 14; 16; 17 with which it is in direct contact. Each value for one of these distances can be subdivided to provide an indication of its absolute value and of its spatial direction.

In a standard configuration, which is based upon the values FN11; FN12; FN21; FN22; FN31; FN32; FN41; FN42; FN51; FN52; FN61; FN62 for the contact pressures that are stored in the memory device of the control unit 60, in the direct contact between rollers 04; 06; 07; 08; 09; 11 that are adjustable, in terms of their contact pressure, and rotational bodies 12; 13; 14; 16; 17, with the two being engaged on one another, a specific degree of flattening of the respective cylindrical circumferential surface of the roller 04; 06; 07; 08; 09; 11, the rotational body 12; 13; 14; 16; 17, or both results. A chord of the flattened area, corresponding to the width of the roller strip N11; N12; N21; N22; N31; N32; N41; N42; N51; N52; N61; N62, extends along the circumference of the roller 04; 06; 07; 08; 09; 11 or of the rotational body 12; 13; 14; 16; 17. The standard configuration generates a degree of flattening that corresponds to a specific target value for the width of each roller strip which is selected N11; N12; N21; N22; N31; N32; N41; N42; N51; N52; N61; N62, in order to achieve a high quality of the printed product to be produced, using the printing couple 01 under standard operating conditions.

In the case of operating conditions that deviate from the standard, for example, because the diameter of one of the rollers 04; 06; 07; 08; 09; 11, that is adjustable in terms of its contact pressure, or because the diameter of one of the rotational bodies 12; 13; 14; 16; 17, is expanded, such as, for example, due to a substance containment, and especially due to an absorption of moisture, or because the diameter has decreased as a result of wear, it is necessary to correct the width of a roller strip or of multiple roller strips N11; N12; N21; N22; N31; N32; N41; N42; N51; N52; N61; N62 that has changed as a result of the change in diameter, until the width of each roller strip N11; N12; N21; N22; N31; N32; N41; N42; N51; N52; N61; N62 again corresponds to its target value. Alternatively, operating conditions may require that the width of each roller strip N11; N12; N21; N22; N31; N32; N41; N42; N51; N52; N61; N62 be adjusted to a new target value. In both cases, the contact pressure exerted in each relevant roller strip N11; N12; N21; N22; N31; N32; N41; N42; N51; N52; N61; N62 must be adjusted to a new value FN11; FN12; FN21; FN22; FN31; FN32; FN41; FN42; FN51; FN52; FN61; FN62, which adjustment will necessitate that values for the radial forces Fn1; Fn2; Fn3; Fn4, of the affected roller locks 21, be changed.

The control unit 60 is equipped with at least one control element and, with, for example, one display device for use in displaying one or more values FN11; FN12; FN21; FN22; FN31; FN32; FN41; FN42; FN51; FN52; FN61; FN62 for the contact pressure that is exerted in a specific roller strip N11; N12; N21; N22; N31; N32; N41; N42; N51; N52; N61; N62. The reference symbols for the roller strips N11; N12; N21; N22; N31; N32; N41; N42; N51; N52; N61; N62, which have been chosen here by way of example, can also be used as identification codes for the roller strips N11; N12; N21; N22; N31; N32; N41; N42; N51; N52; N61; N62, so that each roller strip N11; N12; N21; N22; N31; N32; N41; N42; N51; N52; N61; N62 can be clearly identified by its identification code.

By use of the control element of the control unit 60, which control element is configured, for example, as a button, as a keypad, or as a pointer instrument, a specific roller strip N11; N12; N21; N22; N31; N32; N41; N42; N51; N52; N61; N62 can be selected, for example, from a list of all roller strips N11; N12; N21; N22; N31; N32; N41; N42; N51; N52; N61; N62 in a printing couple 01 that are provided with an identification code. Alternatively, the identification code of a specific roller strip N1l; N12; N21; N22; N31; N32; N41; N42; N51; N52; N61; N62 can be input into the control unit 60 via its control element. For each of these roller strips N11; N1 2; N21; N22; N31; N32; N41; N42; N51; N52; N61; N62, at least for the standard configuration, a value FN11; FN12; FN21; FN22; FN31; FN32; FN41; FN42; FN51; FN52; FN61; FN62, especially a target value, for the contact pressure exerted in the roller strip N11; N12; N21; N22; N31; N32; N41; N42; N51; N52; N61; N62 is stored in the memory device of the control unit 60. During the selection of, or during the input of the identification code for a specific roller strip N11; N12; N21; N22; N31; N32; N41; N42; N51; N52; N61; N62 this value FN11; FN12; FN21; FN22; FN31; FN32; FN41; FN42; FN51; FN52; FN61; FN62 is displayed, such as, for example, numerically, alphanumerically, in a diagram, or in a pictogram on the display device, which display device is capable of displaying alphanumeric or graphic symbols.

With the use of the control element, the displayed value FN11; FN12; FN21; FN22; FN31; FN32; FN41; FN42; FN51; FN52; FN61; FN62 for the contact pressure which is exerted in the roller strip N11; N12; N21; N22; N31; N32; N41; N42; N51; N52; N61; N62, is adjusted to a new value FN11; FN12; FN21; FN22; FN31; FN32; FN41; FN42; FN51; FN52; FN61; FN62 for the contact pressure exerted in the roller strip N11; N12; N21; N22; N31; N32; N41; N42; N51; N52; N61; N62. The displayed value FN11; FN12; FN21; FN22; FN31; FN32; FN41; FN42; FN51; FN52; FN61; FN62 is adjusted, for example continuously or gradually, and preferably in stages of 10% of the displayed value, by the control element. Alternatively, the control element is used to select a specific factor from a list of available factors by which the displayed value FN11; FN12; FN21; FN22; FN31; FN32; FN41; FN42; FN51; FN52; FN61; FN62 should be adjusted.

For the new value FN11; FN12; FN21; FN22; FN31; FN32; FN41; FN42; FN51; FN52; FN61; FN62 of the contact pressure to be exerted in the selected roller strip N11; N12; N21; N22; N31; N32; N41; N42; N51; N52; N61; N62, the control unit 60 calculates the correct values for the radial forces Fn1; Fn2; Fn3; Fn4 to be exerted in the relevant roller lock 21 and/or for the new pressures to be set in the actuators 22, and stores the calculated values for these radial forces Fn1; Fn2; Fn3; Fn4 and/or for these pressures in its memory device. The control unit 60 also controls the valves V15; V25; V35; V45; V55; V65, the proportional valves EP1; EP2; EP3; EP4 and the valves EPS; EP6. The calculation of the new values FN11; FN12; FN21; FN22; FN31; FN32; FN41; FN42; FN51; FN52; FN61; FN62 and/or the control of the valves V15; V25; V35; V45; V55; V65, the proportional valves EP1; EP2; EP3; EP4 and/or the valves EP5; EP6 is preferably implemented after the control unit 60 has received a specific instruction to do so, which specific instruction can, for example, be input or selected via the control element.

The calculation of the new values FN11; FN12; FN21; FN22; FN31; FN32; FN41; FN42; FN51; FN52; FN61; FN62 for the contact pressures takes into account the fact that these values and the radial forces Fn1; Fn2; Fn3; Fn4, in their original levels, and their new levels, are each to be viewed as a vector quantity. Accordingly, the control unit 60 uses suitable methods for calculating vector quantities. For instance, in addition to appropriate algebraic calculating methods, other methods, such as, for example, trigonometric calculating methods can also be used to calculate individual components of the respective vectors. In the calculation process, the control unit 60 includes, to the degree necessary, its previously input, essentially unchangeable values, such as, for example, the respective mass of the adjustable rollers 04; 06; 07; 08; 09; 11 and the distance from the center of each roller 04; 06; 07; 08; 09; 11, that is adjustable in terms of its contact pressure, to the center of its respective adjacent rotational body 12; 13; 14; 16; 17. The result of the calculation can be displayed by the display device of the control unit 60, for example in the same manner as the original values FN11; FN12; FN21; FN22; FN31; FN32; FN41; FN42; FN51; FN52; FN61; FN62.

In order to set the new value FN11; FN12; FN21; FN22; FN31; FN32; FN41; FN42; FN51; FN52; FN61; FN62 for the contact pressure that is exerted in a selected roller strip N11; N12; N21; N22; N31; N32; N41; N42; N51; N52; N61; N62, the control unit 60 first uses at least one of the valves V15; V25; V35; V45; V55; V65 to actuate the fixation device of the specific roller lock 21 in which the radial force Fn1; Fn2; Fn3; Fn4 of at least one actuator 22 is to be adjusted to the calculated new value. The adjustable roller 04; 06; 07; 08; 09; 11 that is seated in this roller lock 21 can now be radially displaced. The control unit 60 then actuates at least one of the proportional valves EP1; EP2; EP3; EP4 and/or at least one of the valves EP5; EP6 in order to adjust the radial force Fn1; Fn2; Fn3; Fn4 of at least one actuator 22 in the respective roller lock 21 to the calculated new value. Afterward, the control unit 60 again actuates the at least one valve V15; V25; V35; V45; V55; V65, that was actuated previously, to shift the fixation device of that roller lock 21, in which the radial force Fn1; Fn2; Fn3; Fn4 of at least one actuator 22 has been adjusted to the calculated new value, to the operational position, in which the roller 04; 06; 07; 08; 09; 11, that is adjustable in terms of its contact pressure and which is seated in this roller lock 21, can no longer be radially displaced. The new value FN11; FN12; FN21; FN22; FN31; FN32; FN41; FN42; FN51; FN52; FN61; FN62 for the contact pressure, which is exerted in a selected roller strip, N11; N12; N21; N22; N31; N32; N41; N42; N51; N52; N61; N62 also results in a change in The width of this roller strip N11; N12; N21; N22; N31; N32; N41; N42; N51; N52; N61; N62.

The above-described change in a value FN11; FN12; FN21; FN22; FN31; FN32; FN41; FN42; FN51; FN52; FN61; FN62 for the contact pressure exerted in a selected roller strip N11; N12; N21; N22; N31; N32; N41; N42; N51; N52; N61; N62 can be implemented for multiple rollers 04; 06; 07; 08; 09; 11, that are adjustable in terms of their contact pressure, either simultaneously or sequentially. For example, the values FN11; FN12; FN21; FN22; FN31; FN32 of all of the contact pressures exerted by the forme rollers 04; 06; 07, in other words the dampening forme roller 04 and the ink forme rollers 06; 07, can be changed at the same time. Alternatively, the value FN21; FN22; FN31; FN32; FN51; FN52; FN61; FN62 of all of the contact pressures which are exerted by the rollers 06; 07; 09; 11 of the inking unit 02, or the values FN11; FN12; FN41; FN42 of all of the contact pressures which are exerted by the rollers 04; 08 of the dampening unit 03,orthevalues FN11; FN12; FN21; FN22; FN31; FN32; FN41; FN42; FN51; FN52; FN61; FN62 of the contact pressures of all of the rollers 04; 06; 07; 08; 09; 11 in the printing couple 01 can be changed at the same time. Thus, groups of simultaneously adjustable values FN11; FN12; FN21; FN22; FN31; FN32; FN41; FN42; FN51; FN52; FN61; FN62 can be formed. With the control unit 60, the values FN11; FN12; FN21; FN22; FN31; FN32; FN41; FN42; FN51; FN52; FN61; FN62 of the contact pressures of all of the rollers 04; 06; 07; 08; 09; 11 that are to be adjusted, in terms of their contact pressure, such as, for example, those of an inking unit 02 and/or of a dampening unit 03, can be reset within a time period of less than one minute, and preferably can be reset within a period of a few seconds.

Each value FN11; FN12; FN21; FN22; FN31; FN32; FN41; FN42; FN51; FN52; FN61; FN62 of the contact pressure exerted by a roller 04; 06; 07; 08; 09; 11, which has been changed once or even multiple times, for example via the control element in the control unit 60, to the value FN11; FN12; FN21; FN22; FN31; FN32; FN41; FN42; FN51; FN52; FN61; FN62 that corresponds to the standard configuration, and especially to the target value for the contact pressure which is exerted in the corresponding roller strip, N11; N12; N21; N22; N31; N32; N41; N42; N51; N52; N61; N62, can be reset.

The control unit 60 is configured, for example, as a component of a control center that is part of the printing machine or that, at least, is a part of the printing couple 01, and is thus allocated to the printing machine or to the printing couple 01. As an alternative or in addition, the control unit 60 can be configured, for example, as a mobile component, such as, for example, as a notebook, which is connected to the controllable device that is actuated for the purpose of implementing such a change, in other words particularly to the respective proportional valves EP1; EP2; EP3; EP4, to the valves EP5; EP6 and to the valves V15; V25; V35; V45; V55; V65, only when a value FN11; FN12; FN21; FN22; FN31; FN32; FN41; FN42; FN51; FN52; FN61; FN62 of a contact pressure that is exerted in a roller strip N11; N12; N21; N22; N31; N32; N41; N42; N51; N52; N61; N62 is to be changed.

To implement a change in the value FN11; FN12; FN21; FN22; FN31; FN32; FN41; FN42; FN51; FN52; FN61; FN62 of a contact pressure that is exerted in a roller strip N11; N12; N21; N22; N31; N32; N41; N42; N51; N52; N61; N62, proof of authorization may be required. Accordingly, prior to implementation of the change, for example, a recognizable password must be input into the control unit 60 via its control element.

The change in the value FN11; FN12; FN21; FN22; FN31; FN32; FN41; FN42; FN51; FN52; FN61; FN62 of a contact pressure that is exerted in a roller strip N11; N12; N21; N22; N31; N32; N41; N42; N51; N52; N61; N62 can be implemented during the rotation of the respective roller 04; 06; 07; 08; 09; 11. As long as at least one channel, with a preferably slot-shaped, continuous opening that extends in an axial direction along the forme cylinder 12, and over at least the width of at least one printing forme, and which channel is configured to hold attachment hooks that are bent at the printing formes, is formed on the circumferential surface of the forme cylinder 12 in its axial direction, the change in the value FN11; FN21; FN31 of the contact pressure exerted in this roller strip N11; N21; N31 can occur when the opening in the channel and the roller strip N11; N21; N31 have no common overlapping surface. This is to insure that during the setting of the new value of the contact pressure exerted in this roller strip N11; N21; N31,the roller 04; 06; 07 will not be pressed into the opening in the channel. Accordingly, the contact pressure, which is exerted in a roller strip N11; N21; N31,is changed by the control unit only at times during which the roller 04; 06; 07 that is to be displaced and/or that is to be adjusted in terms of its contact pressure, is rolling on the closed, customarily solidly configured portion of the circumferential surface of the forme cylinder 12 and/or on the surface of at least one printing forme that is mounted on the forme cylinder 12. During the rollover of the roller over the opening in the channel, the control unit 60 blocks any change in the setting of the contact pressure which is exerted in the roller strip N11; N21; N31.

To verify this condition, a sensor that registers the current angular position of the forme cylinder 12 and/or of the roller 04; 06; 07, such as a torque angle gauge, which transmits a signal corresponding to the current angular position to the control unit 60, can be attached to the forme cylinder and/or to the roller 04; 06; 07. The control unit 60 evaluates the transmitted signal as a release signal which is indicating the permissibility of a change in the setting of a contact pressure that is exerted in the roller strip N11; N21; N31. If the above condition cannot be fulfilled, or if it can be fulfilled only with complications, the forme cylinder 12 and the roller 04; 06; 07 in whose joint roller strip N11; N21; N31 the value FN11; FN21; FN31 of the contact pressure exerted therein is to be changed are placed in rotation, specifically at a speed at which a rollover of the opening in the channel by the roller 04; 06; 07 during the setting of the new value for its contact pressure exerted in this roller strip N11; N21; N31 will not produce a negative effect. The duration of the rollover is very short, and thus will outweigh the effect of the inertia of the masses involved. Furthermore, the implementation of the change in the value FN11; FN12; FN21; FN22; FN31; FN32; FN41; FN42; FN51; FN52; FN61; FN62 of a contact pressure exerted in a roller strip N11; N12; N21; N22; N31; N32; N41; N42; N51; N52; N61; N62 during the rotation of the respective roller 04; 06; 07; 08; 09; 11 also has the advantage of preventing slip-stick effects. The change in the value FN11; FN12; FN21; FN22; FN31; FN32; FN41; FN42; FN51; FN52; FN61; FN62 of a contact pressure which is exerted in a roller strip N11; N12; N21; N22; N31; N32; N41; N42; N51; N52; N61; N62 is thus implemented during the rotation of the relevant roller 04; 06; 07; 08; 09; 11 and its respective adjacent rotational body 12; 13; 14; 16; 17 at a speed of, for example, at least 3,000 revolutions per hour, and preferably at a speed of at least 5,000 revolutions per hour or more. The implementation of the change in the value FN11; FN12; FN21; FN22; FN31; FN32; FN41; FN42; FN51; FN52; FN61; FN62 of a contact pressure which is exerted in a roller strip N11; N12; N21; N22; N31; N32; N41; N42; N51; N52; N61; N62 can thus also take place when the printing couple 01 is running in production.

While preferred embodiments of devices for adjusting contact pressure exerted on an adjacent rotational body by a roller in a roller strip and/or for engaging the roller on the rotational body and/or for disengaging the roller from the rotational body, in accordance with the present invention have been set forth fully and completely hereinafter, it will be apparent to one of skill in the art that various changes in, for example, the source of the compressed air or hydraulic fluid, the sizes of the cylinders and rollers, and the like could be made without departing from the true spirit and scope of the present invention, which is accordingly to be limited only by the appended claims.

What is claimed is:

1. A device for adjusting a contact pressure exerted by each of a plurality of rollers on an adjacent rotational body in a printing couple comprising:

a plurality of first rollers, each of said first rollers being supported in said printing couple for rotation about a roller longitudinal axis and having first and second roller ends, a first roller circumference and a first roller weight;

an adjacent rotational body having a rotational body circumference and being engageable by at least selected ones of said plurality of first roller circumferences;

a separate roller strip formed by said engagement of each of said selected ones of said plurality of first rollers with said rotational body circumference, each said separate roller strip having a circumferential width in a rotational direction of said at least first roller;

a separate designator usable to identify each one of said separate roller strips;

a separate support bearing for each of said first and second ends of each of said plurality of first rollers;

a roller mount in each said separate support bearing, each said roller mount being shiftable radially in said associated separate support bearing;

a plurality of actuators interposed between each said separate support bearing and each said associated roller mount, each of said plurality of actuators for each said roller mount being adapted to exert radial forces on said roller mount, said plurality of actuators each being usable to impart a controllable contact pressure which is exerted by each of said first and second ends of said selected ones of said plurality of first rollers to form each said first roller strip during operation of said printing couple;

a unique identifying element for each of said actuators for each of said separate support bearings for each of said plurality of first rollers; and a control unit having a display device, said control unit being adapted to select each of said plurality of actuators for each said support bearing using said unique identifying element and said separate roller strip designator and to adjust and to control each of said plurality of actuators in each said separate support bearing independently of additional ones of said actuators in each said separate support bearing to vary said circumferential width of each said roller strip identified by each said separate roller strip designator during said operation of said printing couple, each of said actuators being activatable remotely by said control unit, said display device being adapted to selectively display said controllable contact pressure for each of said selected ones of said plurality of first rollers against said adjacent rotational body.

2. The device of claim 1 further including a pressure medium usable to pressurize each said actuator.

3. The device of claim 1 further including a controllable device allocated to each said support bearing, said control unit using said controllable device to activate each of said plurality of actuators for each said support bearing.

4. The device of claim 3 wherein said controllable device applies pressure to each of said plurality of actuators in each said support bearing synchronously at a first pressure level in a first operational position and at a second pressure level in a second operational position.

5. The device of claim 4 wherein in said first and second operational positions, said first and second pressure levels are different from zero for at least one of said plurality of actuators in each said support bearing.

6. The device of claim 4 wherein said first pressure level and said second pressure level in different ones of said plurality of actuators in each said support bearing are different from each other.

7. The device of claim 4 wherein said first and second pressure levels are different.

8. The device of claim 1 wherein one of said first and second ends of one of said plurality of first rollers imparts a contact pressure different from a contact pressure imparted by the other of said first and second ends of said one of said plurality of first rollers.

9. The device of claim 1 wherein each said actuator in each said support bearing exerts a radial force directed towards said support bearing.

10. The device of claim 9 wherein said contact pressure imparted by each said roller on said adjacent rotational body is a vector sum of said portion of said roller weight and said radial forces exerted by said actuators.

11. The device of claim 1 wherein said plurality of first rollers and said adjacent rotational body are arranged in a printing couple of a printing machine.

12. The device of claim 11 wherein said printing machine is a newspaper printing press.

13. The device of claim 1 wherein said control unit is allocated to said printing machine.

14. The device of claim 13 further including at least one channel having an opening in said forme cylinder.

15. The device of claim 14 wherein said control unit varies said circumferential width of each said first roller strip when said at least one channel opening and said roller strip are out of alignment with each other.

16. The device of claim 1 wherein said adjacent rotational body is a forme cylinder.

17. The device of claim 16 further including a plurality of printing formes arranged in an axial direction on said forme cylinder.

18. The device of claim 17 further including at least four of said printing formes covering said forme cylinder in said axial direction of said forme cylinder.

19. The device of claim 1 wherein said rotational body is a supplementary roller.

20. The device of claim 1 wherein said control unit adjusts and controls said radial forces to be exerted by each said actuator to provide said controllable contact pressure having a specific value.

21. The device of claim 1 further including controllable valves usable by said control unit to adjust said radial forces to be exerted by each of said plurality of actuators.

22. The device of claim 1 wherein said control unit determines said contact pressure including a distance of a center point of each said first roller from a center point of said adjacent rotational body, and said portion of said roller weight determined by multiplication of a gravitational constant by a mass of each said first roller.

23. The device of claim 1 wherein said value for said controllable contact pressure can be changed.

24. The device of claim 23 further including wherein said control unit is adapted to determine said radial forces exerted by said actuators in response to a change in said displayed value.

25. The device of claim 23 further including controllable valves operable by said control unit and usable to vary said controllable contact pressure through said control element.

26. The device of claim 25 wherein said control unit adjusts said value of said controllable contact pressure displayed on said display device by control of said controllable valves.

27. The device of claim 26 wherein said plurality of first rollers and said adjacent rotational body define a printing couple and where a rotational speed of each said plurality of first said rollers is at least 3000 rph.

28. The device of claim 1 wherein said control unit is adapted to display on said display device a value of said controllable contact pressure, said value being derived from said radial forces exerted by said actuator and from a portion of said first roller weight of each of said plurality of first rollers.

29. The device of claim 1 wherein each said separate support bearing includes a controllable fixation device, said fixation device, in a first position blocking said radial shifting of said roller mount, and in a second position allowing said radial shifting of said roller mount.

30. The device of claim 29 further including fixation devices at said separate support bearings for said first and second ends of each said roller and being operable at the same time.

31. The device of claim 29 further including a controllable valve usable to change said fixation device between said first position and said second position.

32. The device of claim 29 further including using said control unit to place said controllable fixation device in said second position, using said control device to change said value of said contact pressure while said controllable device is in said second position and then using said control unit to place said controllable fixation device in said first operational position.

33. The device of claim 1 further including several of said adjacent rotational bodies engageable by said plurality of said first rollers concurrently.

34. The device of claim 1 wherein each of said plurality of first rollers and said adjacent rotational body are components of one of an inking unit and a dampening unit of a printing couple of a printing machine.

35. The device of claim 1 wherein said plurality of actuators interposed between each said separate support bearing and each said associated roller mount are non-rotatable with respect to said support bearing.

36. The device of claim 1 wherein said plurality of actuators are distributed in a circular pattern around an axis of rotation of each said roller.

37. The device of claim 36 wherein said circularly arranged ones of said actuators in each said support bearing are each assigned their unique identifying element in a fixed sequence.

38. The device of claim 1 further including pressure medium conduits connected in parallel to said plurality of actuators.

39. The device of claim 1 wherein said plural actuators in each said support bearing are connected by separate pressure medium conduits at separate pressure levels.

40. The device of claim 1 wherein each said actuator is a tubular component.

41. The device of claim 40 wherein each said tubular component is at least partially an elastomeric material.

42. The device of claim 1 wherein said plurality of actuators in each said separate support bearing form an opening angle with respect to each other.

43. The device of claim 42 wherein said opening angle is different from 0° and 180°.

44. The device of claim 42 wherein said opening angle is between 45° and 135°.

45. The device of claim 1 wherein actuators in said support bearing at said first end of one of said plurality of first rollers exert a first contact pressure and further wherein said actuators in each support bearing at said second end of said one of said plurality of first rollers exert a second contact pressure different from said first contact pressure.

46. The device of claim 45 further wherein said adjacent rotational body is a forme cylinder having a plurality of printing formes in an axial direction of said forme cylinder, said plurality of printing formes not completely covering said forme cylinder in said axial direction.

47. The device of claim 1 wherein each said support bearing is assigned a support bearing identifying element.

48. The device of claim 1 wherein each said actuator identifying element and each said support bearing identifying element form an identification code.

49. The device of claim 48 wherein said identification code is machine readable.

50. The device of claim 1 wherein said control unit is a mobile component.

51. The device of claim 1 wherein said control unit is connected to each one of said plurality of actuators only when a value of said contact force is to be changed.

52. The device of claim 1 further including a controllable valve between said control unit and each said actuator, said control unit being connected to each of said valves only when said valve is to be controlled.

53. The device of claim 52 wherein said valves are one of electrically and electromagnetically actuated.

54. The device of claim 1 further including a memory device in said control unit.

55. The device of claim 54 further including at least one set of values stored in said memory device, said at least one set of values defining a standard configuration for each value corresponding to said contact pressure to be exerted by each said roller against said adjacent rotational body.

56. The device of claim 55 wherein said values of said standard configuration generate flattening on one of a surface of each said roller and of said adjacent rotational component, said flattening being usable to achieve a level of print quality in a printed product printed by the printing couple.

57. The device of claim 1 further including providing groups of simultaneously adjustable values for said radial forces in said control unit.

58. The device of claim 57 further including at least one of an inking unit and a dampening unit including said plurality of first rollers, said groups of simultaneously adjustable values being usable with said inking unit and said dampening unit.

59. The device of claim 57 wherein said adjacent rotational body is a forme cylinder and said groups of simultaneously adjustable valves are usable with said plurality of first rollers configured as forme rollers and being operable with said forme cylinder.

60. The device of claim 1 wherein said control unit adjusts said contact pressure in a time period of less than one minute.

61. The device of claim 1 wherein each said actuator exerts a contact pressure using one of hydraulic, electric, motor-driven and piezoelectric action.

62. The device of claim 1 wherein said control unit is usable to determine a value of said controllable contact pressure exerted by each of said plurality of first rollers using said radial forces exerted by said actuators in each said support bearings and at least a portion of a force of weight exerted by each said roller.

63. The device of claim 1 wherein said circumferential width of each said separate roller strip is variable along said longitudinal axis of each of said plurality of first rollers.

* * * * *